US008341897B2

(12) United States Patent
Margarites

(10) Patent No.: US 8,341,897 B2
(45) Date of Patent: Jan. 1, 2013

(54) PITCH POCKET ASSEMBLY

(75) Inventor: Christopher Margarites, Hawthorn Woods, IL (US)

(73) Assignee: ADCO Products, Inc., Michigan Center, MI (US)

( * ) Notice: Subject to any disclaimer, the term of this patent is extended or adjusted under 35 U.S.C. 154(b) by 0 days.

(21) Appl. No.: 13/072,269

(22) Filed: Mar. 25, 2011

(65) Prior Publication Data

US 2011/0232225 A1 Sep. 29, 2011

Related U.S. Application Data

(60) Provisional application No. 61/318,281, filed on Mar. 27, 2010.

(51) Int. Cl.
*E04B 7/00* (2006.01)
*E04H 12/28* (2006.01)

(52) U.S. Cl. ..... 52/198

(58) Field of Classification Search ..... 52/58, 60, 52/302.5, 302.6, 631, 716.2, 741.4
See application file for complete search history.

(56) References Cited

U.S. PATENT DOCUMENTS

| | | | | |
|---|---|---|---|---|
| 1,494,234 | A | 5/1924 | Gossett | |
| 3,708,185 | A | 1/1973 | Bilicki et al. | |
| 3,838,544 | A | 10/1974 | Hindall | |
| 3,945,163 | A | 3/1976 | Nagler et al. | |
| 4,635,409 | A * | 1/1987 | Vandemore | 52/60 |
| 4,928,443 | A | 5/1990 | Goodman et al. | |
| 4,934,117 | A | 6/1990 | Bardsdale | |
| 4,937,991 | A | 7/1990 | Orth | |
| 4,944,118 | A | 7/1990 | Biro | |
| 5,605,019 | A * | 2/1997 | Maziekien et al. | 52/58 |
| 5,872,203 | A | 2/1999 | Wen et al. | |
| 5,899,034 | A | 5/1999 | Vermilion et al. | |
| 6,623,578 | B2 | 9/2003 | Wasitis et al. | |
| 7,152,449 | B2 * | 12/2006 | Durney et al. | 72/324 |
| 2003/0014926 | A1 | 1/2003 | Champa et al. | |
| 2004/0045233 | A1 | 3/2004 | Beele | |
| 2005/0204648 | A1 | 9/2005 | Bibaud et al. | |
| 2005/0249872 | A1 | 11/2005 | Cox et al. | |
| 2006/0201102 | A1 | 9/2006 | Shah | |
| 2006/0272249 | A1 | 12/2006 | Janoski et al. | |
| 2006/0283100 | A1 | 12/2006 | Evensen | |
| 2008/0209835 | A1 * | 9/2008 | Margarites | 52/518 |

* cited by examiner

*Primary Examiner* — Joshua J Michener
*Assistant Examiner* — Keith Minter
(74) *Attorney, Agent, or Firm* — Vivacqua Law, PLLC; Raymond J. Vivacqua

(57) ABSTRACT

A pitch pocket assembly for sealing an aperture in a roof includes a first member and a plurality of flashing members. The first member includes a wall portion and a plurality of flashing portions. The plurality of flashing portions extend from and are substantially perpendicular to the wall portion proximate at least one deformation zone. The plurality of flashing members are each attached to the first member. Each of the flashing members at least partially overlaps at least one of the flashing portions. The wall portion of the first member is bendable along each of the deformation zones to form a pitch pocket having the flashing members at least partially overlapping the flashing portions of the first member.

10 Claims, 3 Drawing Sheets

PITCH POCKET ASSEMBLY

CROSS-REFERENCE TO RELATED APPLICATIONS

This application claims the benefit of U.S. Provisional Application No. 61/318,281 filed on Mar. 27, 2010. The disclosure of the above application is incorporated herein by reference.

TECHNICAL FIELD

The present invention relates to pitch pockets, and more particularly to pitch pockets for sealing an interface between a surface and a projection extending from the surface.

BACKGROUND

The statements in this section merely provide background information related to the present disclosure and may or may not constitute prior art.

In the construction of many types of low slope roofs, a water impervious upper layer covering the surface of the roof is commonly used to prevent water from penetrating the roof structure. Although different materials are used depending on the type of roof constructed, this waterproof layer or surface is generally referred to as a roof membrane.

Roofs often have one or more elements extending upwardly and physically penetrating or extending through the membrane. These elements include pipes, vents, conduits or support members. Where these elements extend through the roof, they pierce the roof membrane and define potential leak paths for water to penetrate through the membrane. To prevent water from leaking or migrating through the membrane at these points, special care must be taken to seal the hole created in the membrane by the penetrating element.

One common technique of accomplishing this is by using a roof curb or pitch pocket. The pitch pocket is essentially a rigid or semi-rigid structure mounted to the roof that surrounds the penetration element. This structure is then filled with a pourable sealer. The pitch pocket itself must then be sealed or flashed to ensure that no water enters under the seal. While current pitch pockets often seal the projection adequately, there is a need for new and improved pitch pockets that exhibit improved packaging and ease of installation.

SUMMARY

The present invention is directed to an improved pitch pocket comprising a roofing cup/collar device, two-sided, adhesive tape and pourable sealant. More specifically, the present invention comprises a wrap-able, roofing cup/collar of various materials, pourable sealant and two-side adhesive tape. One side of the adhesive tape is adhered to roofing side of the collar base, while the other side is then adhered to roofing surface.

A preferred embodiment of the present invention comprises an expandable pocket system comprising overlapping flange (collar) plates and a bendable cup portion of the pocket. The expandable pocket has tab and slot system for closing off the cup portion, once the configuration is completed.

In another aspect of the present invention, a pitch pocket assembly for sealing an aperture in a roof includes a first member and a plurality of flashing members. The first member includes a wall portion and a plurality of flashing portions. The wall portions have a top edge, a bottom portion opposing the top edge, an outer surface, an inner surface opposing the outer surface, and at least one deformation zone. The deformation zones and the inner and outer surfaces each extend between the top edge and the bottom portion. The plurality of flashing portions extend from and are substantially perpendicular to the outer surface of the wall portion proximate the bottom portion and at least one of the deformation zones. The plurality of flashing members are each attached to the first member proximate the bottom portion of the wall portion of the first member. Each of the plurality of flashing members at least partially overlaps at least one of the plurality of flashing portions of the first member. The wall portion of the first member is bendable along each of the deformation zones to form a pitch pocket having the flashing members at least partially overlapping the flashing portions of the first member.

An advantage of the present invention is an instant sealing pitch pocket. Another advantage of the present invention is the avoidance of the use of caulking and other messy and difficult to measure and meter adhesives. Still another advantage of the present invention is pitch pocket that can be quickly applied to a roof.

DESCRIPTION OF THE PREFERRED EMBODIMENTS

Figure 1:
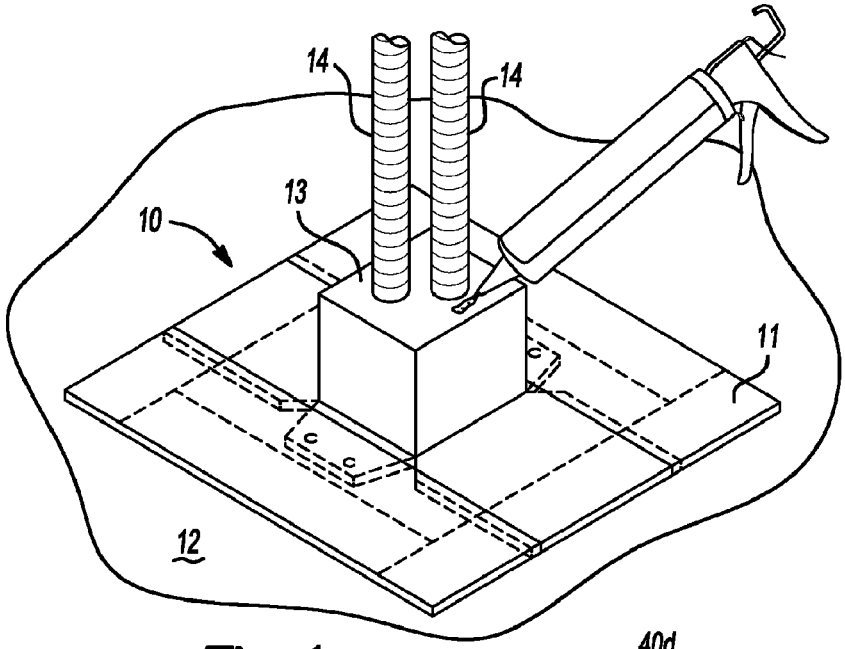
FIG. 1 is a perspective view of a pitch pocket installed on a roof, wherein the open cavity of the installed pitch pocket is being filled with a sealant from a caulking gun.

Certain terminology is used herein for convenience only and is not to be taken as a limitation on the present invention. Further, in the drawings, the same reference numerals are employed for designating the same elements, and in order to clearly and concisely illustrate the present invention, certain features may be shown in somewhat schematic form.

FIG. 1 illustrates a pitch pocket assembly 10 installed on a roof 12. In the example provided, the pitch pocket assembly 10 is employed to seal an interface between projections 14 and the roof 12. The pitch pocket assembly 10 is preferably bent into shape during installation to form a pocket or cup, as will be described below. It should be appreciated that although the assembly 10 is shown with a square configuration, square, rectangular, circular, combinations thereof may be employed. Generally, the total perimeter length of the pocket portion of the assembly 10 will range from about 8-40 inches and the height is about 2-6 inches tall.

Roof 12 may be a flat roof or a sloped roof without departing from the present invention. Roof 12 may comprise PVC, EPDM, modified bitumen, TPO, Hypolan, Kynar, coated metal, masonry, smooth surfaced asphalt, or any other material used in residential or commercial roofing.

The projections 14 are illustrated as pipes in the present example. Pipes are depicted for illustration and not exhaustive of the types of applications for which the present invention is useful. Other protrusions of a roof may be air conditioning refrigerant lines, hot or cold water pipes, heating ducts or exhaust ducts, structural steel, wood or other members, and the like. Because holes have been made in the roof 12 to allow projections 14 to protrude, the roof membrane is now compromised. Water, snow, sleet, dust, gravel or other falling objects from the air or roof can fall down the holes and damage the interior of the building. In order to prevent any such damage, a pitch pocket 10 of the present invention may be employed.

The present example shows the hat or pitch pocket assembly 10 adhered to the roof 12 with an adhesive tape 11 and filled with a sealant 13. The adhesive tape 11 may include various adhesive materials. The adhesive tape 11 is preferably a high peel strength polyolefin/synthetic elastomer composition. For example, the adhesive tape 11 may be Eternabond brand Double-Stick™ Microsealant™ adhesive tape (Eternabond Inc., Mundelein, Ill.). Other examples of suitable adhesive tape include butyl rubber and other synthetic elastomeric adhesives. The 11 is a two-sided adhesive, having release liner on each of its faces. After the release liners are removed from each of the faces, one face adheres to the roof 12 and the other face adheres to an underside of the pitch pocket assembly 10. The tape 11 may be of various thicknesses and widths. A typical tape 11 will have a thickness of from about 20 to 150 mils, more preferably about 60 to 120 mils. The tape 11 may also comprise two layers of adhesive tape and will typically have a width of from 1 to 5 inches and, preferably, about 2.5-3 inches.

Figure 2A:
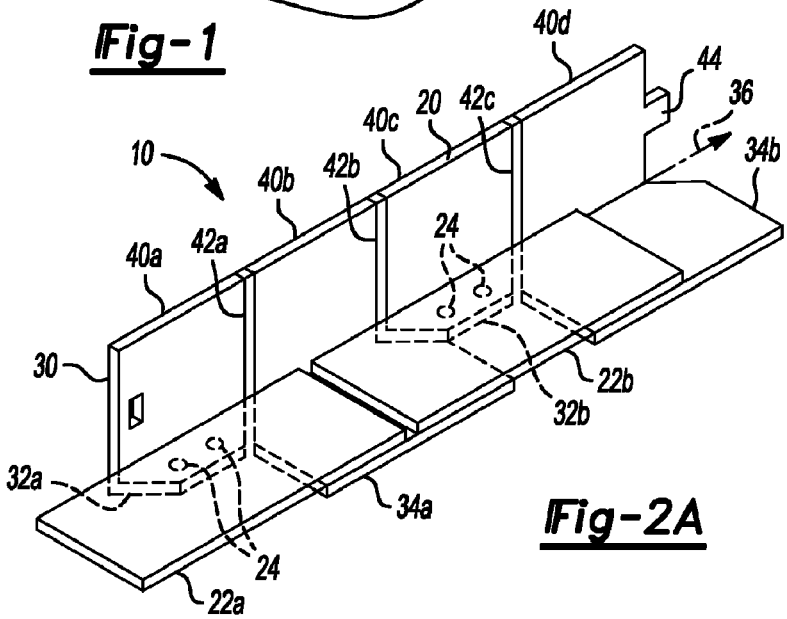
FIG. 2A is a perspective view of a pitch pocket assembly in accordance with aspects of the present invention.
Figure 2B:
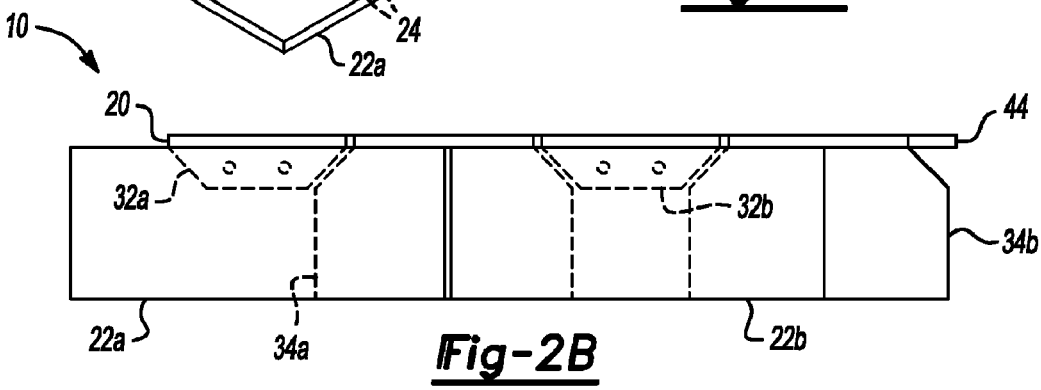
FIG. 2B is a top plane view of the pitch pocket assembly shown in FIG. 2A in accordance with aspects of the present invention.

Referring now to FIGS. 2A and 2B, and with continued reference to FIG. 1, the pitch pocket assembly 10 is shown in isometric and top plan views in a pre-installation condition. The pitch pocket assembly 10 includes a pocket member 20, a first plate or flashing member 22A, a second plate or flashing member 22B, and a plurality of fastening members 24. The members 20, 22A, 22B, 24 preferably have a thickness of from about 20 to 150 mils, and more preferably about 50-100 mils, such as 18-24 gauge metal. Metal or plastic are preferred materials for use with the assembly 10, and stainless steel or galvanized steel are most preferred materials.

The fastening members 24 join the flashing members 22A, 22B with the pocket member 20. The pre-installation condition is the preferred condition for supplying the pitch pocket assembly 10 to roofing installers, and has the flashing members 22A-B attached to the pocket member 20 and the pocket assembly 10 is not yet bent to form a pocket.

Figure 3:
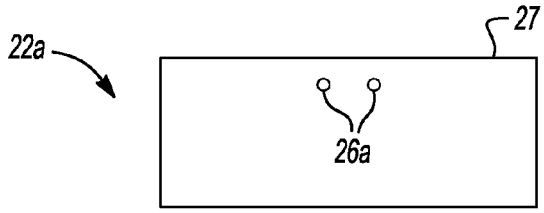
FIG. 3 is a top plan view of a flashing member of a pitch pocket assembly in accordance with aspects of the present invention.

Referring now to FIG. 3 and with further reference to FIGS. 2A and 2B, the first flashing member 22A is shown in a top plan view. The flashing member 22A is generally rectangular in shape and is preferably sheet metal. It should be appreciated that other shapes and other materials may be used without departing from the scope of the present invention. The example provided includes two apertures 26A centered along the longitudinal direction of the flashing member 22A and disposed proximate an inside edge 27 of the flashing member. The apertures 26A receive the fastening members 24 to attach the flashing member 22A to the pocket member 20. In alternative embodiments, the apertures 26A are omitted. The second flashing member 22B is similar to the first flashing member 22A and includes apertures 26B, as is best seen in FIG. 2B.

Figure 4:
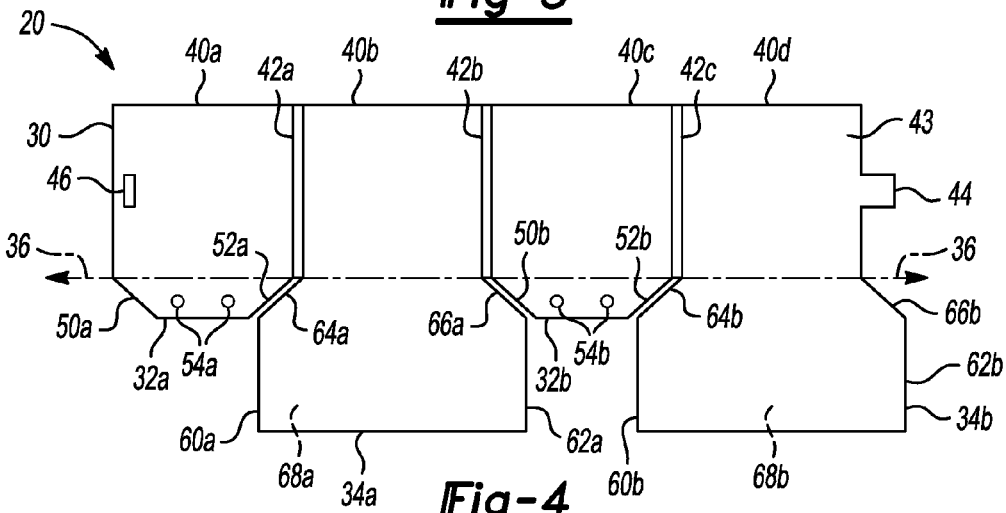
FIG. 4 is a developed view of a pocket member of a pitch pocket assembly in accordance with aspects of the present invention.

Referring now to FIG. 4, and with continued reference to FIGS. 2A and 2B, a developed view of the pocket member 20 is shown. The pocket member is preferably a shaped piece of sheet metal or other material exhibiting similar plastic deformation characteristics. It should be appreciated that other materials may be used without departing from the scope of the present invention. The pocket member 20 includes a wall portion 30, a first flange portion 32A, a second flange portion 32B, a first flashing portion 34A, and a second flashing portion 34B. The pocket member is bent at a 90-degree angle along a line 36 to prepare the pocket member 20 for assembly.

The wall portion 30 is generally rectangular in shape and has four equally sized rectangular sections 40A, 40B, 40C, 40D separated by three deformation zones or grooves 42A, 42B, 42C along the longitudinal direction of an outer surface 43 of the wall portion 30. Each of the sections 40A-D is forms a side wall of the pitch pocket assembly 10 during installation, as will be described below. Each of the grooves 42A-C is generally an indented portion for ease of bending the pitch pocket assembly 10 at the desired location, as will be described below. It should be appreciated that the grooves 42A-C may be omitted and the sections 40A-D may be differently proportioned without departing from the scope of the present invention. For example, in alternative embodiments the second and fourth sections are longer than the first and third sections to form an elongated rectangular shaped pocket area upon installation. The wall portion 30 further includes a tab portion 44 and a slotted aperture 46. The tab portion 44 extends away from the section 40D along a longitudinal direction of the wall portion 30 parallel with the line 36. The slotted aperture 46 is defined by the section 40A and disposed and sized to receive the tab portion 44 when the assembly 10 is bent into an installation condition. It should be appreciated that other features may be employed to engage the fourth section 40D with the first section 40A, such as a tongue in groove or a hook feature.

The flange portions 32A-B extend from and are substantially perpendicular to the wall portion 30 at a bottom of the first section 40A. The first flange portion 32A has a first beveled edge 50A and a second beveled edge 52A extending from the edges of the first section 40A towards the inside of the first section 40A longitudinally and away from the wall portion 30 laterally. The first flange portion 32A further includes apertures 54A centered on the flange portion 32A for attaching the first flashing member 22A to the flange portion 32A with the fasteners 24. The second flange portion 32B is substantially coplanar with the first flange portion 32A and extends from the wall portion 30 at a bottom of the third section 40C. The second flange portion 32B has a first beveled edge 50B and a second beveled edge 52B extending from the edges of the third section 40C towards the inside of the third section 40C longitudinally and away from the wall portion 30 laterally. The second flange portion 32B further includes apertures 54B centered on the flange portion 32B for attaching the second flashing member 22B to the flange portion 32B with the fasteners 24.

The first flashing portion 34A extends from and is substantially perpendicular to the second section 40B of the wall portion 30. The first flashing portion 34A has a first edge 60A aligned longitudinally within the first section 40A that opposes a second edge 62A that is aligned longitudinally within the third section 40C. A first chamfer 64A extends between the second section 40B of the wall portion 30 and the first edge 60A and a second chamfer 66A extends between the second section 40B of the wall portion 30 and the second edge 62A. The first flashing portion 34A has a bottom surface 68A that opposes the roof 12 when the pitch pocket assembly 10 is installed.

The second flashing portion 34B extends from and is substantially perpendicular to the fourth section 40D of the wall portion 30. Similarly, the second flashing portion 34B has a first edge 60B aligned longitudinally within the third section 40C that opposes a second edge 62B that is aligned longitudinally beyond the fourth section 40D. A first chamfer 64B extends between the fourth section 40D of the wall portion 30 and the first edge 60B and a second chamfer 66B extends between the fourth section 40D of the wall portion 30 and the second edge 62B. The second flashing portion 34B has a bottom surface 68B that opposes the roof 12 when the pitch pocket assembly 10 is installed. It should be appreciated that different numbers and shapes of flashing portions may be used without departing from the scope of the present invention. In alternative embodiments the flashing portions are members that are separate from but attached to the wall portion.

Figure 5A:
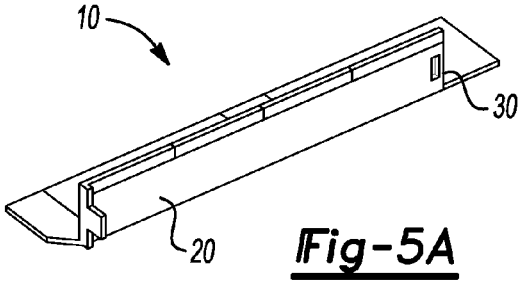
FIG. 5A is a view of a pitch pocket assembly in a pre-installation condition in accordance with the principles of the present invention.
Figure 5B:
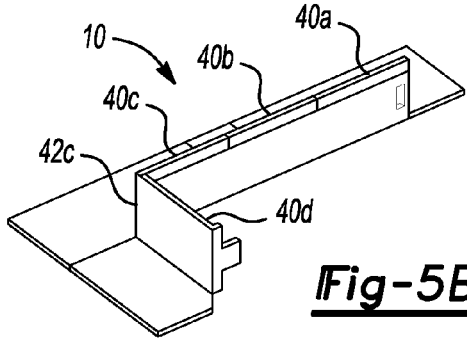
FIG. 5B is a view of a pitch pocket assembly demonstrating an exemplary step of preparing the pitch pocket assembly for installation in accordance with the principles of the present invention.
Figure 5C:
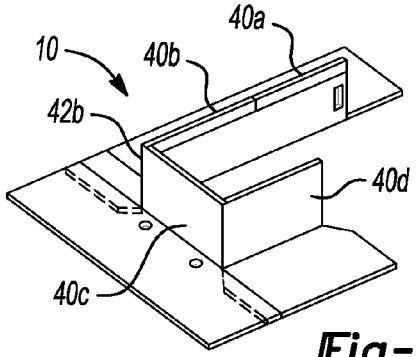
FIG. 5C is a view of a pitch pocket assembly demonstrating an exemplary step of preparing the pitch pocket assembly for installation in accordance with the principles of the present invention.
Figure 5D:
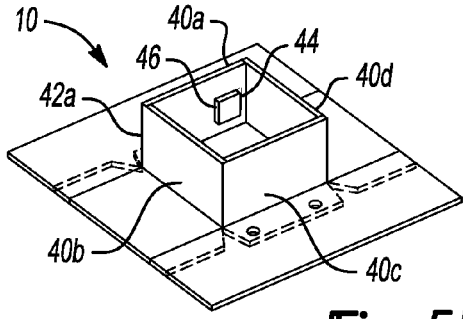
FIG. 5D is a view of a pitch pocket assembly demonstrating an exemplary step of preparing the pitch pocket assembly for installation in accordance with the principles of the present invention.

Referring now to FIGS. 5A-D, and with continued reference to FIG. 1, the pitch pocket assembly 10 is shown in various stages of installation. The pitch pocket 10 is shown in a pre-installation condition in FIG. 5A before the wall portion 30 of the first member 20 has been bent to form a pocket. FIG. 5B shows the pitch pocket 10 after the wall portion 30 has been bent at the groove 42C to make the fourth section 40D of the wall portion 30 perpendicular to the remainder of the wall portion 30. FIG. 5C shows the pitch pocket 10 after the wall portion 30 has been bent at the groove 42B to make the third section 40C of the wall portion 30 perpendicular to the remainder of the wall portion 30. FIG. 5D shows the pitch pocket 10 after the wall portion 30 has been bent at the groove 42A to put the pitch pocket assembly 10 into an installation condition where the first section 40A opposes the third section 40C and the second section 40B opposes the fourth section 40D of the wall portion 30 to create a pocket. The tab 44 is inserted into the slotted aperture 46 to help maintain the boxed shape of the pitch pocket 10 for installation on the roof 12.

Prior to installation the roof 12 is preferably wiped clean or cleaned with a solvent to prepare the surface for the tape 11. The tape 11, having release liner on front and back faces, is cut to shape according to the dimensions of the assembly 10. For square or rectangular shaped pitch pockets, a perimeter shape of tape 1 will be laid down on the roof 12. The tape 11 may be flush with the perimeter of the pitch pocket or inset or outset by about 0.5-2 inches within the perimeter of the assembly 10 after bending into shape. A first side release liner is removed from the tape 11 and the exposed adhesive is pressed into the roof 12. After the first layer of tape 11 is set on the roof, the remaining release liner of the tape 11 is removed. If desired, a second layer of tape 11 may be placed directly over the exposed first layer of adhesive after first removing the release liner of a first face of the second layer and pressing the exposed adhesive into the top of the first layer of the adhesive tape 11. The release liner of the second face of the second layer is then removed, exposing the adhesive second layer.

The bottom surfaces 68A-B of flange portions 34A-B are placed around the projections 14 and the holes and directly over the tape 11. The assembly 10 is then pressed onto the tape 11, forming a water-tight seal between the roof 12 and the assembly 10.

Alternatively, the release liner may be removed from a first face of the tape 11 and applied, flush or inset, around the perimeter of the bottom surfaces 68A-B. The second release liner is then removed from the tape 11 and the assembly 10 is then pressed into the roof 12, forming a water-tight seal between the roof 12 and the assembly 10.

Once the assembly 10 is sealed to the roof 12, the sealant 13 is then poured into the open cavity formed by the opposing sections 40A-D of the wall portion 30 of the pocket member 20. Generally the assembly 10 will be filled nearly level to the top of the wall portion 30 or slightly overflowing. Suitable materials used for sealant 13 include 100% solids, a semi self-leveling moisture cure sealant, or a pre-polyurethane pourable sealant. The sealant 13 can be custom made or obtained from readily available sources but preferably is a two-part reactive polyurethane which forms a solid when curing after exposure to the atmosphere over a relatively short period of time.

Figure 6:
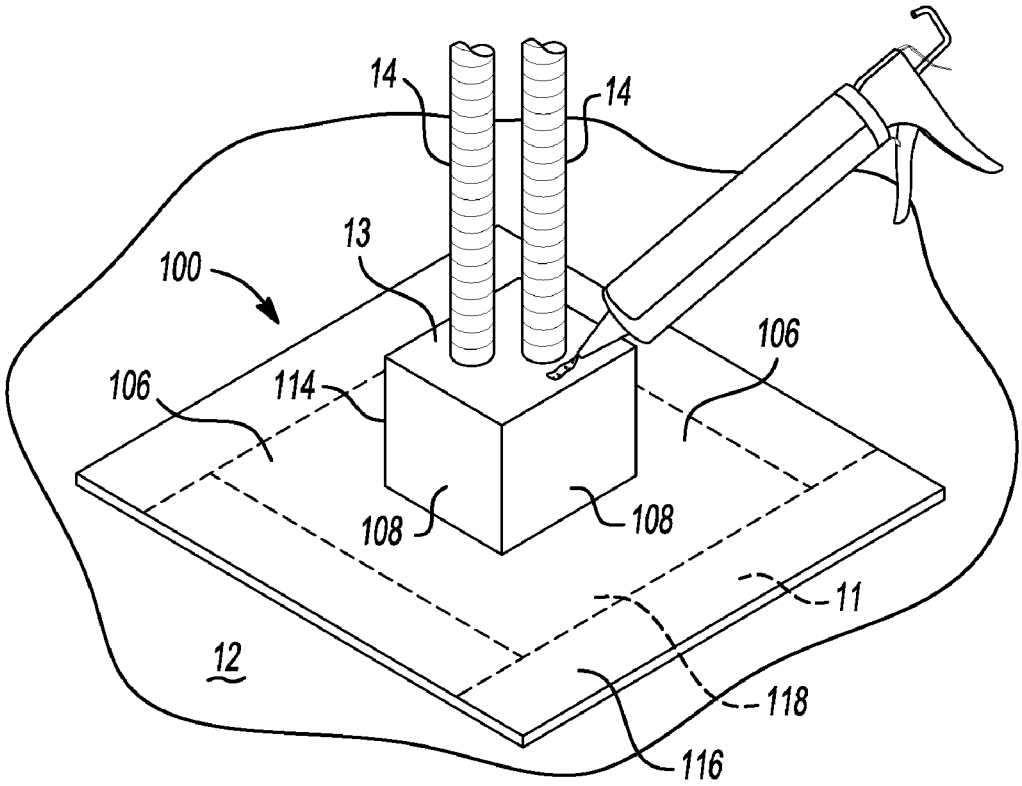
FIG. 6 is a view of an embodiment of a pitch pocket assembly in accordance with principles of the present invention.

Referring now to FIG. 6, an alternative embodiment of a hat or pitch pocket assembly 100 is shown in accordance with principles of the present invention. Assembly 100 comprises a flange plate 106 and a cup or pocket member 114. The plate 106 has a top surface 116 and a bottom surface 118. The plate 106 may be square, rectangular, circular or a combination thereof. The plate 106 and sides 108 of pocket member 114 will generally have a thickness of from about 20 to 150 mils, preferably about 50-100 mils, which corresponds to an 18-24 gauge metal. The plate 106 and the pocket member 114 may be made of metal or plastic, and preferably will be made of stainless steel or galvanized steel. The plate 106 may be a single seamless piece of material or may be made with an open seam or of several overlapping pieces, creating multiple seams. If projections 14 are pre-existent, then the assembly 100 will have at least one open seam which will allow the plate 106 and the cup 114 to slide past the projections 14 to surround the projections 14 and the holes through which they project.

The pocket member 114 protrudes normal to the plane of the plate 106 and can be shaped and sized as needed to adequately surround the projections 14 and the holes through which they project. The pocket member 114 has sides 108 or, if the pocket member 114 is cylindrical, then one continuous side 108. Generally, the pocket member 114 will be shaped like a cube with square sides 108, or as a prism or box, with rectangular sides 108. The sides 108 have a height and width that will vary. Generally, the total perimeter length of sides 108 will range from about 8-40 inches. Generally, the pocket member 114 will have sides 108 that are about 2-6 inches tall, running from the plate 106 to the top of the sides 108. As stated above, the pocket member 114 may have an open seam running from top to bottom of the side 108, so as to allow the pocket member 114 to wrap around the projections 14 and the holes through which they project.

While the best modes for carrying out the invention have been described in detail, those familiar with the art to which this invention relates will recognize various alternative designs and embodiments for practicing the invention within the scope of the appended claims.

What is claimed is:

1. A pitch pocket assembly for sealing an aperture in a roof, the pitch pocket assembly comprising:

a first member including:

a substantially rectangular wall portion having a top edge, a bottom portion opposing the top edge, an outer surface, an inner surface opposing the outer surface, and at least one deformation zone, wherein the deformation zones and the inner and outer surfaces each extend between the top edge and the bottom portion;

a plurality of flashing portions extending from and substantially perpendicular to the outer surface of the wall portion proximate the bottom portion and at least one of the deformation zones;

a plurality of flange portions extending from the outer surface of the wall portion proximate the bottom portion; and a plurality of flashing members each attached to the first member proximate the bottom portion of the wall portion of the first member, wherein each of the plurality of flashing members at least partially overlaps two of the plurality of flashing portions of the first member and one of the plurality of flange portions of the first member, and wherein the wall portion of the first member is bendable along each of the deformation zones to form a pitch pocket having the flashing members at least partially overlapping the flashing portions of the first member.

2. The pitch pocket assembly of claim 1 wherein the wall portion of the first member includes a first section, a second section adjacent the first section, a third section adjacent the second section, and a fourth section adjacent the third section, wherein the sections are separated from each other by one of the at least one deformation zones, and wherein a first flashing portion of the plurality of flashing portions of the first member extends from the second section of the wall portion and a second flashing portion of the plurality of flashing portion extends from the fourth section of the wall portion.

3. The pitch pocket assembly of claim 2 wherein the first, second, third, and fourth sections of the wall portion are substantially equal in size.

4. The pitch pocket assembly of claim 2 wherein the first flashing portion extends to be disposed partially opposite the first section and the third section, and wherein the second flashing portion extends to be disposed partially opposite the third section.

5. The pitch pocket assembly of claim 2 wherein the deformation zones are grooves that delineate the first, second, third, and fourth sections to assist with bending the wall portion during installation of the pitch pocket assembly.

6. The pitch pocket assembly of claim 1 wherein each of the plurality of flashing members is secured to the respective flange portion with at least one fastener.

7. The pitch pocket assembly of claim 1 wherein the wall portion of the first member further includes a tab and defines a slot, wherein the tab is configured to engage the slot when the pitch pocket assembly is installed on a roof.

8. The pitch pocket assembly of claim 1 wherein the flashing members are coplanar.

9. The pitch pocket assembly of claim 8 wherein each of the plurality of flashing members is disposed at least partially overtop of at least one of the plurality of flashing portions.

10. The pitch pocket assembly of claim 1 wherein the first member and the flashing members are made of sheet metal.

* * * * *